United States Patent [19]

Kaiser

[11] Patent Number: 4,887,371

[45] Date of Patent: Dec. 19, 1989

[54] DREDGES

[76] Inventor: Johann F. Kaiser, 6 Tweed Street, Bilambil Heights NSW 2485, Australia

[21] Appl. No.: 224,295

[22] Filed: Jul. 26, 1988

[51] Int. Cl.[4] ..... E02F 3/92

[52] U.S. Cl. ..... 37/66; 37/56; 37/189; 37/DIG. 20

[58] Field of Search ..... 37/66, 56, 64, 67, 189, 37/190, DIG. 20, 58

[56] References Cited

U.S. PATENT DOCUMENTS

| | | | |
|---|---|---|---|
| 3,683,521 | 8/1972 | Sloan et al. | 37/56 |
| 4,646,449 | 3/1987 | Steinkühler et al. | 37/66 |
| 4,650,017 | 3/1987 | Pelletter et al. | 37/DIG. 20 X |

*Primary Examiner*—Dennis L. Taylor
*Assistant Examiner*—J. Russell McBee
*Attorney, Agent, or Firm*—Charles W. Fallow; Martin P. Hoffman

[57] ABSTRACT

A submersible dregde assembly which includes a mobile carriage which locates on and may be driven about the submerged surface of the sea, river or bay under control from the surface and which carries a rotatable bucket wheel for engaging the surface and displacing material therefrom. The displaced material is conveyed to a remote location by means of a pump which withdraws material from the region of the bucket wheel by suction. The assembly also includes arrangements for adjusting the attitude of the bucket wheel so that a level dredged surface can be formed.

13 Claims, 4 Drawing Sheets

DREDGES

BACKGROUND OF THE INvENTION

1. Field of the Invention

This invention relates to improvements to dredges and in particular to dredges of the type for removing sand, mud, or other material from the bed of a river, sea, bay or other like areas.

2. Description of the Related Art

Conventional dredges usually employ a floating structure such as a barge which supports a dredging assembly which may include a crane having a bucket which is lowered into engagement with say the bed of a river to scoop up material therefrom while in other arrangement, the dredging assembly may comprise a rotatable bucket wheel on one end of an arm which is pivotally supported on the floating structure so as to be moveable into engagement with the river bed and a suction duct is associated with the bucket wheel to convey displaced material to the surface or a remote location. The conventional arrangements including the above have a number of limitations particularly in the depths to which they can operate and furthermore such arrangements are not suited to use in confined areas. Generally, also, such known configurations are structurally large and therefore costly. Furthermore, conventional bucket wheel dredging systems do not function efficiently particularly in slewing operations as only one side of the bucket wheel effectively functions while the suction duct draws in material and water from both sides of the wheel.

BRIEF SUMMARY OF THE INVENTION

The present invention aims to overcome or alleviate one or more of the above disadvantages by providing a dredge assembly which does not have the operational limitations associated with standard dredges, which is less expensive than the known arrangements and which will operate in a reliable and efficient manner particularly in confined areas. The present invention also aims to provide an improved bucket wheel configuration for use in the above assembly or other dredging or excavation machines.

With the above and other objects in view, the present invention resides broadly in a submersible dredge assembly comprising a mobile carriage adapted to be located on the bed of a river, sea, bay, or other submerged surface, drive means associated with said carriage and operative to move said carriage about said bed, dredging means supported on said carriage and adapted to engage said bed and displace material therefrom and means for conveying said displaced material to a remote location.

Suitably, the carriage is supported by driveable ground engaging means such as endless caterpillar-type tracks to enable the carriage to move over a desired area of the bed. Suitable also the carriage supports a rotatable turntable assembly which carries the dredging means so as to enable pivotal movement of the dredging means about a substantially vertical axis so that a broad area adjacent the carriage can be dredged. In a preferred form the dredging means includes a rotatable bucket wheel which is supported on an arm hinged to the turntable assembly to be pivotal towards and away from the bed being worked. Preferable, the turntable assembly includes a base portion which is supported adjustably on the carriage, the base portion supporting a rotatable turntable which carries the bucket wheel of the dredge. Most preferably, the base portion is supported for pivotal movement about a longitudinally extending axis so as to enable adjustment and levelling of the turntable in a transverse direction and thus levelling adjustment of the bucket wheel to ensure that a horizontal cut is made into the bed. Preferably, adjustment of the base portion occurs automatically suitably with the use of a hydraulic ram or rams which respond to pendulum controlled valves mounted to the turntable assembly. Pendulum controlled valves may also be used to control the pivotal movement of the bucket wheel about a horizontal axis again to ensure level dredging by the bucket wheel.

The rotatable bucket wheel of the dredge preferably includes a plurality of buckets and means are provided for dividing said buckets into first and second opposite parts, and means are associated with said first and second parts of said buckets and are adapted to withdraw material displaced by said first or said second parts of said buckets.

Suitably, the buckets are divided into their first and second parts by a central wall whereby during slewing operations, only one side of the buckets function to displace material and the material withdrawing means are associated with that side of the buckets. Preferably, the material withdrawing means comprise respective suction pipes associated with each side of the bucket wheel, each being selectively operable in accordance with the operational side of the bucket wheel. Suitably, the respective suction pipes communicate through a selectively actuable valve assembly with a pump. In one preferred arrangement, the valve means operate automatically to communicate the suction pipe on the operative side of the bucket wheel with the pump. The bucket wheel described above while being particularly suited for use in submersible dredges as described, may also be used in other dredge assemblies or excavators.

The tracks of the dredge assembly carriage are adapted to be driven independently by respective hydraulic motors and the pump for the dredge assembly is also driven by a hydraulic motor. The dredge pump suitably communicates with a main discharge duct which extends to the surface or to a remote location and preferably, the duct is connected to the pump via a swivel gland assembly to allow relative movement between the pump and duct in both the horizontal and vertical directions.

The dredge assembly may be associated with a land based command unit which controls operation of the assembly. Alternatively, the dredge assembly may include a vessel, suitably a catamaran type vessel to which the dredge assembly may be connected via lifting cables, hydraulic lines or other control means.

BRIEF DESCRIPTION OF DRAWINGS

In order that the invention may be more readily understood and put into practical effect, reference will now be made to the accompanying drawings which illustrate a preferred embodiment of the invention and wherein.

DETAILED DESCRIPTION OF THE INvENTION

Figures 1, 2:
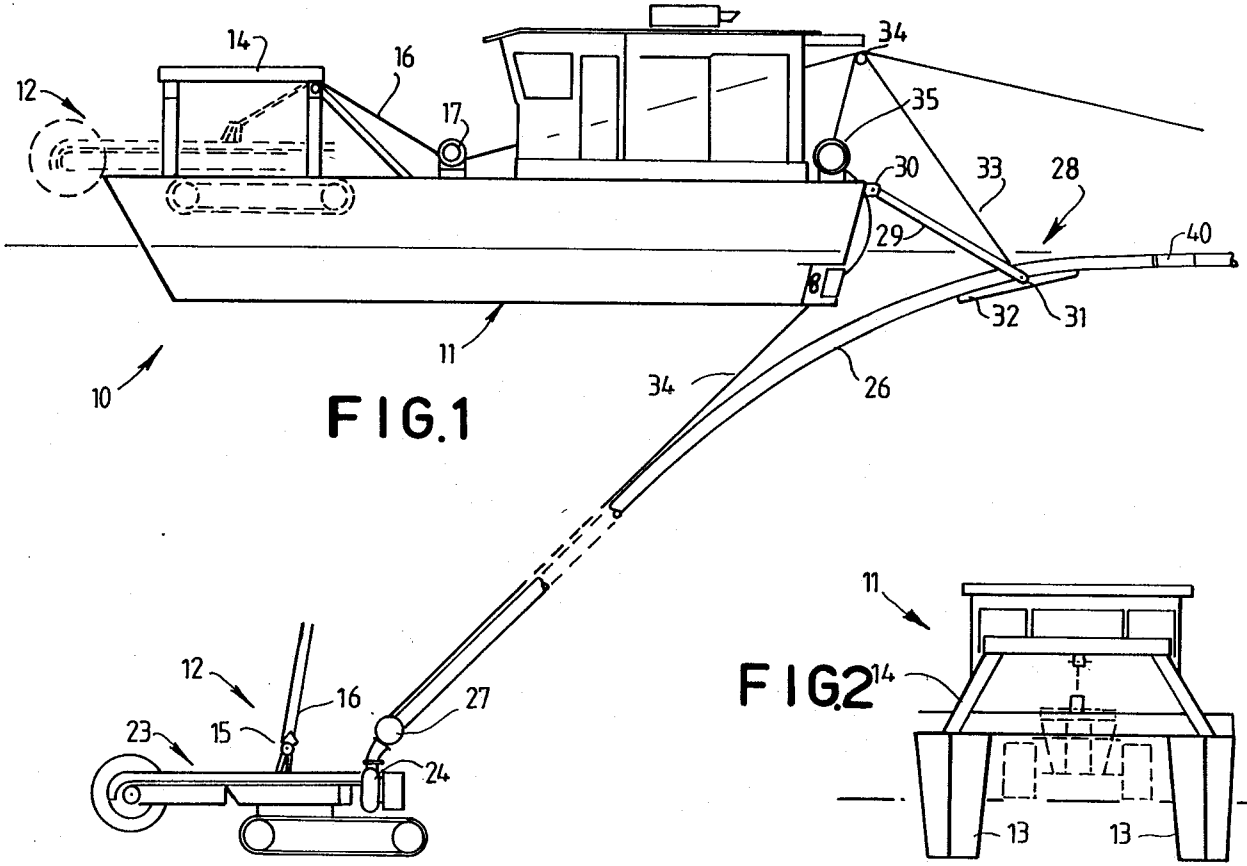
FIG. 1 is an elevational view of one form of dredge assembly according to the invention associated with a floating vessel.
FIG. 2 is a front elevational view of the floating vessel of FIG. 1.

Referring to the drawings and firstly to FIG. 1, there is shown dredging means 10 according to a preferred form of the present invention including a floating vessel 11 and a submersible dredge assembly 12 the operation of which is controlled from the floating vessel 11. As more clearly illustrated in FIG. 2, the vessel 11 is of catamaran type construction including a pair of spaced hulls 13 which may support therebetween the dredge assembly 12 (as shown in dotted outline) for conveyance to a required dredging site. For this purpose, the vessel may be suitably provided with a bridging structure 14 which spans the hulls 13 and the dredge assembly 12 may be supported therefrom via a sheave which guides a winch line 16 of a winch 17 which may be employed to lift the dredge assembly 12 from the water and suspend it above the water. The vessel 11 also includes a hydraulic pump and control valves which control the supply of hydraulic fluid to the dredge assembly 12 and thereby its operation in the manner described below.

Figure 3:
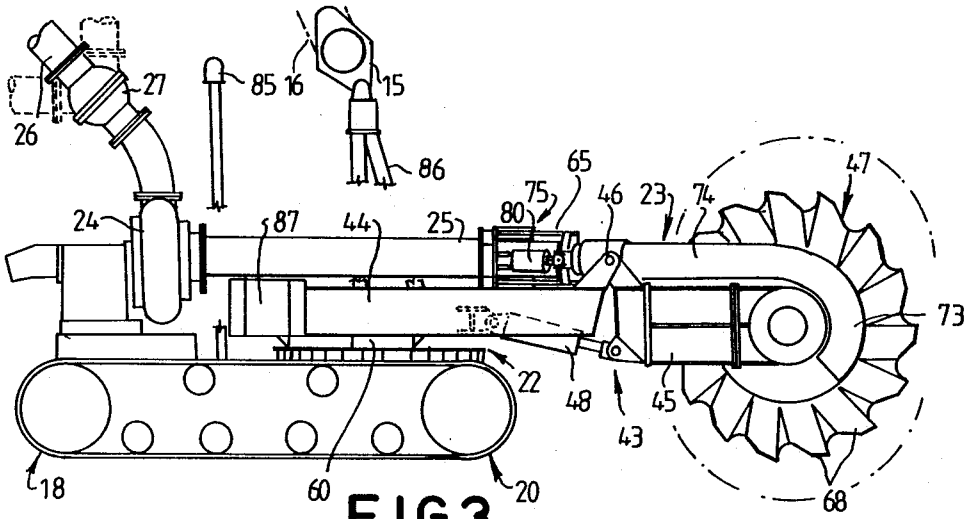
FIG. 3 is an elevational view of the dredge assembly according to the invention.
Figure 4:
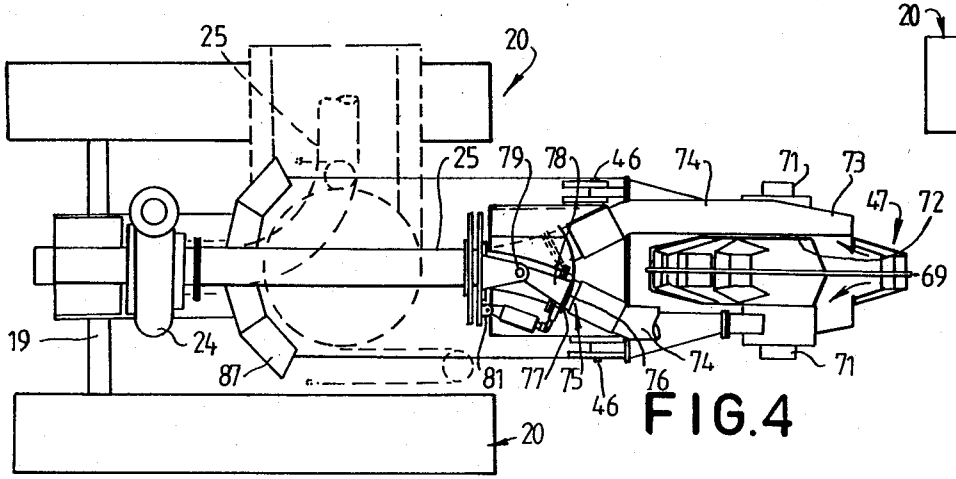
FIG. 4 is a plan view of the dredge assembly of FIG. 3 illustrating the major components thereof.
Figure 5:
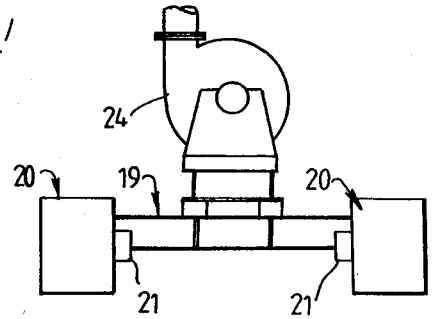
FIG. 5 illustrates the manner of support for the dredge pump on the dredge assembly.

The dredge assembly 12 as more clearly shown in FIGS. 3 and 4 includes a mobile carriage 18 which includes a chassis 19 supported by a pair of caterpillar-type track assemblies 20 each of which is adapted to be driven independently by respective hydraulic motors 21 (see FIG. 5) to enable the carriage 18 to be steered. Supported on the carriage chassis 19 is a turntable assembly 22 which supports a bucket wheel assembly 23 and a dredging pump 24 which is fixedly supported on the chassis 19 and connected by a main duct 25 which is suitably formed of flexible pipe to the bucket wheel assembly 23. The outlet of the pump 24 communicates with a material discharge pipe 26 via a swivel connection 27 which as shown in dotted outline in FIG. 3 permits limited pivotal movement of the pipe 26 relative to the chassis 19 between a horizontal and vertical attitude.

In one arrangement, the pipe 26 is supported from the stern of the vessel 11 at the surface by a support assembly 28 comprising a pair of pivot arms 29 connected pivotally at 30 at one end to the stern of the vessel 11 and supporting pivotally therebetween at 31 at their opposite ends a support member 32 over which the pipe 26 passes.

The arms 29 are supported in a desired position by means of a cable 33 which is connected to the arms 29 adjacent the member 32 and which passes over a sheave 34 to be connected to a winch 35 which may be operated to raise and lower the arms 29 and member 32.

Figure 6:
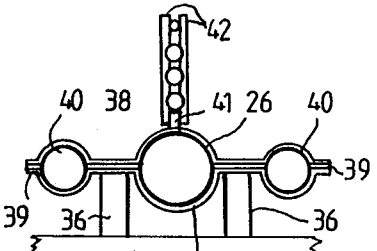
FIG. 6 illustrates details of the slurry delivery line of the dredge assembly.

In an alternative arrangement shown in FIG. 6, a pair of upstanding supports 36 are fixed to the vessel 11 and carry a pair of co-operable clamping members 37 and 38 each of which has corresponding part circular recesses which co-operate when bolted together at 39 to clamp the pipe 26 (and floats 40) therebetween in the manner shown. Pairs of clamping members 37 and 38 are provided along the pipe 26 so that the pipe 26 may be supported by the floats 40 at the surface of water where required.

The upper clamping member 38 includes an upstanding lug 41 to which further pairs of opposed clamping members 42 may be connected by bolting, these members serving to clamp therebetween the hydraulic supply and control lines for the dredge assembly 12.

As shown in FIGS. 3 and 4, the bucket wheel assembly 23 includes a ladder assembly 43 comprising a first part 44 mounted on the turntable assembly 22 and a second part 45 hingedly connected at 46 to the first part 44 via pairs of pivotally interconnected lugs and which carries at its forward end a rotatable bucket wheel 47. The second part 45 may be raised and lowered by means of an hydraulic ram 48 connected between the first and second parts 44 and 45. The ram 48 may be extended or retracted to pivot the second part 45 about a substantially horizontal axis at the pivot connection 46 so that the bucket wheel 47 can be moved towards or away from the bed being dredged as shown in dotted outline in FIG. 3.

Figure 7:
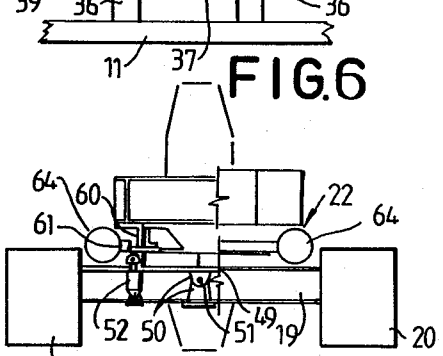
FIG. 7 illustrates in part sectional view, the turntable of the dredge assembly.

Preferably and as shown in FIG. 7, the turntable assembly 22 includes a base portion 49 supported on the chassis 19 by pivotally interconnected lugs 50 for limited pivotal movement about a longitudinal axis 51 and the attitude of the base portion 49 may be varied by means of an hydraulic ram 52 connected between the chassis 19 and base portion 49. The ram 52 may be actuated to pivot the base portion 49 about the axis 51 so that the base portion 49 may be adjusted to adopt a horizontal attitude in a transverse direction. This will ensure that the bucket wheel 47 when pivoted by the turntable assembly 22 operates in a horizontal plane so that a level horizontal surface can be formed in the bed of the river or sea in which it is operating.

Figure 13:
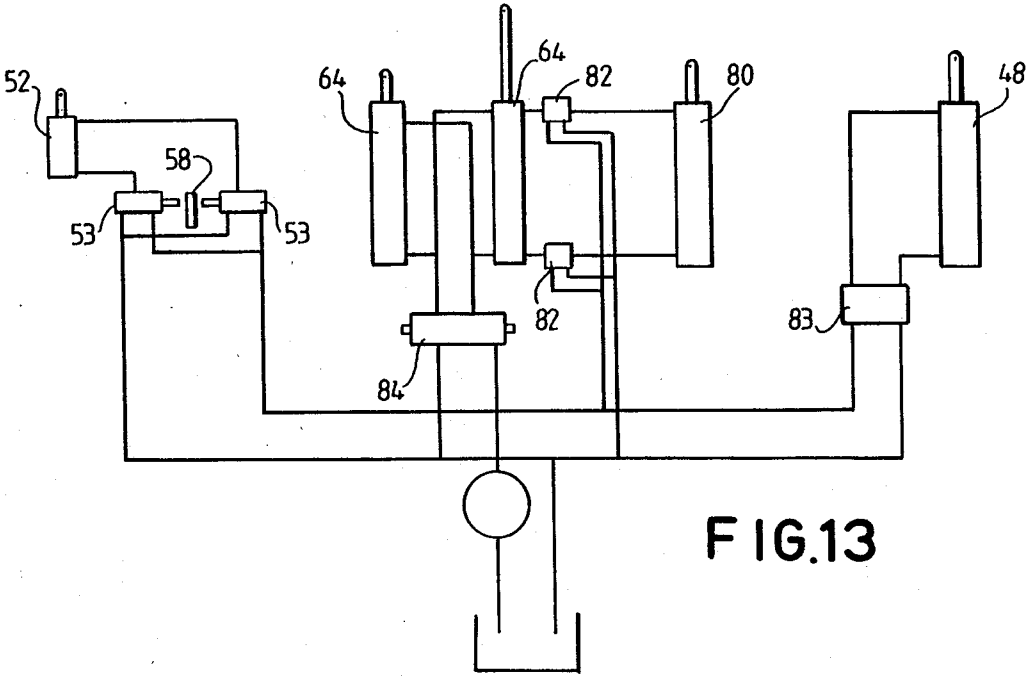
FIG. 13 is a schematic of the hydraulic circuit for control of the dredge assembly.

Preferably, actuation of the ram 52 is controlled automatically so that the turntable assembly 22 can be maintained in a level attitude in a situation where the carriage assembly 18 is on uneven ground. Suitably, the means for controlling the ram 52 includes a pair of pilot valves 53 (see FIG. 8) controlled by a pendulum arm 54, the latter including a weight 55 at one end and being pivotally mounted at 56 for movement about a horizontal axis. The pilot valves 53 and pendulum arm 54 are arranged within a waterproof casing 57 secured to the turntable assembly 22 and the pendulum arm portion 58 is arranged to engage the pilot valve actuators 59 to cause actuation of the respective pilot valves 53 in accordance with the direction of pivotal movement of the pendulum arm 54 consequent upon out of level disposition of the turntable assembly 22 in the transverse direction. The respective pilot valves 53 are connected between a source of pressurised hydraulic fluid supplied from the surface and opposite ends of the ram 52 (see FIG. 13) so that actuation of the ram 52 in opposite directions and thus opposite pivotal movement of the turntable assembly 22 occurs in accordance with the valve 53 actuated by the pendulum arm 54.

Figure 9:
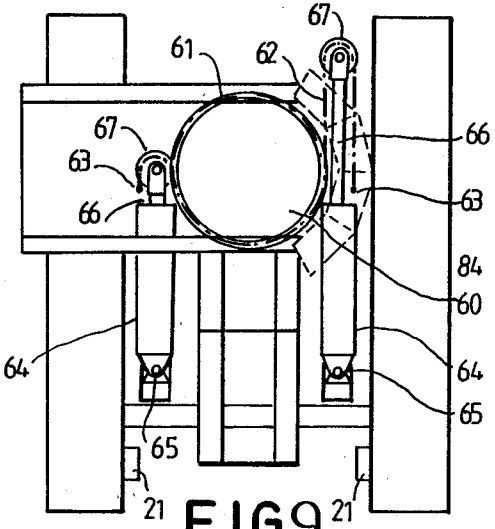
FIG. 9 illustrates in plan view, details of the turntable drive of the dredge assembly.

The base portion 49 of the turntable assembly 22 supports rotatably via suitable bearings such as Acetal-Delvin bearings a turntable 60 to which the first part 44 of the ladder assembly 43 is rigidly secured. As shown in FIGS. 7 and 9, the turntable 60 has fixed thereto a concentric sprocket 61 and a chain 62 passes partway about the sprocket 61 to be anchored at opposite ends at 63 to the base portion 49 on opposite sides of the sprocket 61.

A pair of hydraulic actuators 64 extend longitudinally of the carriage 18 and are arranged on opposite sides of the sprocket 61. The cylinders of the actuators 64 are pivotally mounted at one end 65 to the base portion 49 while the rods 66 of each actuator 64 are provided at their free ends with respective rotatable sprockets 67 about which the chain 62 passes at opposite sides of the main sprocket 61. It will be apparent that corresponding opposite movement of the actuator rods 66 of the respective actuators 64 will cause movement of the chain 62 as shown in dotted outline in FIG. 9 and thus rotational movement of the sprocket 61 and thus the turntable 60 in opposite directions. The arrangement is such that the turntable 60 and thus the bucket wheel assembly 23 can pivot through 180°, that is 90° to each side and the flexible duct 25 between the pump 24 and bucket wheel assembly 23 as shown in dotted outline in FIG. 4 has sufficient length and flexibility to bend without collapsing during this pivotal movement of the turntable 61.

Figure 10:
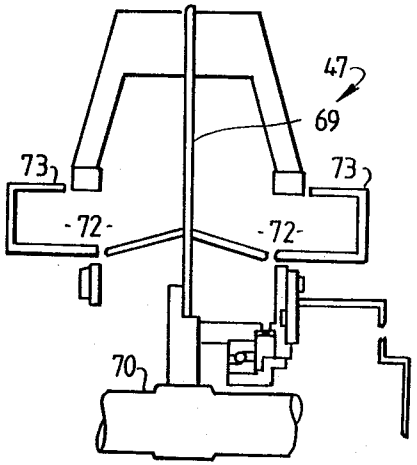
FIG. 10 shows details of the bucket wheel of the dredge assembly.

The bucket wheel 47 as shown in FIGS. 3, 4 and 10 includes a plurality of open buckets 68 spaced circumferentially about the wheel 47 and supported on a central annular dividing wall or plate 69 which serves to divide the buckets 68 into two halves, the dividing wall 69 being mounted fixedly on and extending radially of the shaft 70 of the bucket wheel 47. The shaft 70 is coupled at opposite ends to a pair of hydraulic motors 71 which may be supplied with hydraulic fluid to rotatably drive the bucket wheel 47. The bucket wheel 47 has annular openings 72 on each side which communicate with the respective halves of the buckets 68 while arcuate portions 73 of suction ducts 74 which are open on their sides facing the bucket wheel 47 are disposed on opposite sides of the bucket wheel 47 and adjacent the respective annular openings 72 to communicate therewith as shown in FIG. 10.

The suction ducts 74 extend along the second part 45 of the ladder assembly 43 to communicate with a valve assembly 75 on the first part 44 of the ladder assembly 43. The valve assembly 75 includes an arcuate plate 76 having a pair of spaced openings or ports 77 therein which communicate with the respective suction ducts 74 while the end of the main flexible duct 25 is supported adjacent the plate 76 by a bracket assembly 78 pivotally mounted at 79 for movement about a vertical axis 79 and preferably, the end of the main duct 25 is in rubbing engagement with the plate 76. A ram 80 is connected between the bracket assembly 78 and a bracket 81 on the base portion 49 and may be operated to pivot the bracket assembly 78 about the axis 79 and thus move the main flexible duct end into communication with either opening 77 and thus either suction duct 74.

Thus during slewing operations where only one side of the bucket wheel 47 is cutting into the bed and displacing material therefrom, the end of the main duct 25 supported on the bracket assembly 78 is moved into communication with the duct 74 on the operative side of the wheel 47. Thus water passing into the bucket halves on the opposite side of the wheel 47 is not drawn into the operative suction duct 74 being blocked by the wall 69 so that the density of the slurry passing into the main duct 25 is high.

Preferably, the main duct 25 is "switched" automatically between the respective suction ducts 74 in accordance with the operative side of the bucket wheel 47. For this purpose, a pair of pressure actuated valves 82 (see FIG. 13) may be connected to opposite ends of one of the turntable pivoting actuators 64 so that pressure applied to one end of the actuator 64 representative of a turning force being applied to the turntable 60 will be sensed and cause actuation of one of the valves 82. These valves are connected between a source of pressurised hydraulic fluid and the ram 80 so that actuation of opposite valves 82 causes hydraulic fluid to be applied to the appropriate end of the ram 80 to move the bracket assembly 78 and the end of the main duct 25 into communication with the suction duct 74 corresponding to the operative side of the bucket wheel 47. Similarly, pressure applied to the opposite end of the actuator 64 will be sensed by the other valve 82 to "switch" the main duct 25 to the opposite suction duct 74. Of course many other arrangements may be employed for causing the duct 25 to switch between the respective ducts 74. For example, means may be provided to sense movement of one or other of the actuator rods 66 of the actuators 64 to cause switching of the main duct 25.

Figure 8:
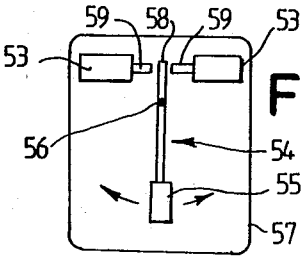
FIG. 8 illustrates a preferred control valve arrangement for controlling the attitude of the bucket wheel.

A pendulum-type valve assembly 83 of the type shown in FIG. 8 is also preferably employed to control the attitude of the bucket wheel assembly 23 by controlling operation of the ram 48. In this case, the valve assembly 83 is supported on the second part 45 of the ladder assembly 43 to sense the attitude thereof so that raising or lowering of the bucket wheel 47 can be controlled to ensure level dredging in both the longitudinal and transverse directions.

Preferably, an angle sensing device is mounted to the turntable 60 and is monitorable at the surface so that the operator has an indication of the angular relationship between the turntable 60 and the chassis 19. Thus the position of the bucket wheel 47 can be monitored and varied from the surface by alternate expanding and retraction of the respective actuators 64 via control valve 84. The carriage 18 also includes a gyro compass 85 which may be monitored from the surface so that disposition of the carriage 18 can be determined.

Also associated with the carriage 18 is a lifting frame 86 secured to the ladder part 44 and provided with lifting sheave 15 about which the winch line 16 passes. The bucket wheel assembly 23 further includes counterweights 87 which are secured to the first part 44 of the ladder assembly 43 to balance the weight of the bucket wheel 47.

In use the vessel 11 carrying the dredge assembly 12 in the manner shown in FIG. 2 is moved to the desired dredging site and suitably anchored. The winch 17 may then be operated to lower the dredge assembly 12 to the sea, river or bay bed along with the slurry discharge pipe 26, the outlet of which may be located say on the shore. The base portion 49 of the turntable assembly 22 adjusts automatically in the transverse direction to a level attitude under the control of the pilot valves 53 and ram 52 and the carriage motors 21 may be operated to move and steer the carriage 18 to the desired dredging position with the direction of movement of the dredge assembly 12 being monitored using the gyro compass 85 from the surface vessel 11.

The bucket wheel 47 may then be operated by applying fluid to the drive motors 71 and lowering the bucket wheel 47 into contact with the bed. At the same time, the dredge pump 24 is operated so that dredged material excavated by the bucket wheel 47 is drawn into the ducts 74, 25 and 26 for passage to the desired deposit site. When all the material in the immediate vicinity of the dredge assembly 12 has been removed to the desired depth, the drive motors 21 for the track assemblies 20 may be operated to advance the dredge assembly 12 in the desired direction.

Figure 12:
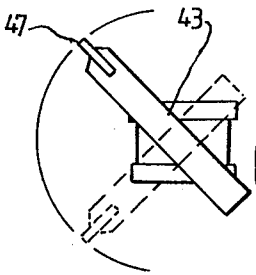
FIGS. 11 and 12 illustrate schematically different modes of operation of the dredge assembly.
Figure 11:
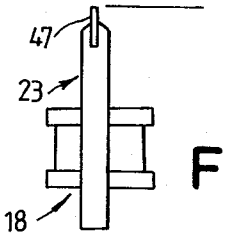

The turntable 60 can be rotated by the hydraulic rams 64 so that the bucket wheel assembly 23 can adopt the attitudes shown in FIGS. 11 and 12. In FIG. 11, the bucket wheel assembly 23 is disposed transverse to the direction of travel of the carriage 18 so that the bucket wheel 47 may operate say on a submerged bank whilst in FIG. 12, the bucket ladder arm 43 is slewed through 180 so that the bucket wheel 47 will clear an arcuate area about the carriage 18. All controls for the dredge assembly 12 are in the vessel 11 and it will be apparent that the dredge assembly 12 may be maneuvered in restricted areas such as canals and rivers and used in other areas such as for beach restoration or river bar clearance.

In an alternative configuration, the dredge assembly 12 may be associated with a land base such as a vehicle or non-mobile command center, the vehicle or command center having controls for the dredge normally carried on the vessel 11. The dredge assembly 12 may then be driven and used in a similar manner to that described above. Using this facility, isolated lakes, rivers or the like are able to be dredged.

The dredging depth of the dredging assembly 12 may be considerably varied with its operating depth only limited by the capacity of the dredge pump. Many different arrangements may be provided for driving the dredge and varying the rotational attitude of the bucket wheel 47 both in a horizontal plane and in a vertical plane. Furthermore, while the preferred dredging device comprises a bucket wheel, other known devices such as bucket chains may be employed.

While the vessel 11 illustrated in the drawings is the preferred vessel for association with the dredge assembly 12 being self propelled and designed to support the dredge assembly 12 in its operative and inoperative attitudes the dredge assembly 12 may be used with existing vessels such as barges provided they can support the necessary controls. The rams or actuators 48 and 52 may be controlled remotely in addition or in substitution for their automatic control so that positioning of the bucket wheel 47 can be undertaken as desired. The ducts 25 and 26 may be formed of any suitable flexible or semiflexible material and it will be apparent that the dredge assembly 12 will be suitably treated or formed of suitable material to resist corrosion.

What I claim is:

1. A submersible dredge assembly comprising a mobile carriage adapted to be located on the bed of a river, sea, bay or other submerged surface, drive means associated with said carriage and operable to move said carriage about said bed, a rotatable turntable on said carriage, dredging means supported on said turntable, said dredging means being adapted to engage said bed and displace material therefrom, means for conveying said displaced material to a remote location, first sprocket means mounted for rotation with said turntable, a chain engaged with said first sprocket means, and actuator means for moving said chain whereby to cause rotation of said first sprocket means and said turntable.

2. A submersible dredge assembly according to claim 1 wherein said chain extends partially about said first sprocket means and is anchored at opposite ends to said carriage and wherein said actuator means includes further freely rotatable sprocket means engaged with said chain and means for advancing and retracting said further sprocket means to cause said chain movement.

3. A submersible dredge assembly according to claim 2 wherein said means for advancing and retracting said further sprocket means includes a hydraulic actuator, said hydraulic actuator including a movable actuator member and wherein said further sprocket means includes a further sprocket mounted for rotation on said actuator member.

4. A submersible dredge assembly according to claim 3 and including a pair of said hydraulic actuators disposed on opposite sides of said first sprocket means, and wherein said further sprocket means includes a pair of further sprockets mounted respectively to the actuator members of the respective said hydraulic actuators and wherein advancement or retraction of the respective said actuator members causes rotation of said first sprocket means and said turntable in opposite directions.

5. A submersible dredge assembly according to claim 1 and including adjusting means associated with said turntable, said adjusting means being operable to adjust said turntable to an attitude such that said dredging means removes material from said bed in a substantially horizontal plane.

6. A dredge assembly according to claim 5 wherein said turntable is supported on said carriage for pivotal movement about an axis extending longitudinally of said carriage, and wherein said adjusting means includes sensing means associated with said dredging means and operative to sense the attitude of said dredging means and actuator means associated with said sensing means and said turntable and operative responsive to said sensing means to pivot said turntable about said axis.

7. A dredge assembly according to claim 1 wherein said conveying means includes pump means supported on said carriage and duct means communicating said pump means with said dredging means and said remote location.

8. A dredge assembly according to claim 1 wherein said dredging means comprises a rotatable bucket wheel.

9. An excavator assembly comprising a mobile carriage, drive means associated with said carriage and operable to cause movement of said carriage, rotatable bucket wheel supported on said carriage, said bucket wheel including a plurality of circumferentially located buckets, means for dividing said buckets into first and second opposite portions, and suction means associated with said first and second portions of said buckets and being adapted to withdraw material displaced by said first and second portions of said buckets, said suction means including a main suction line and first and second suction ducts communicating with the respective said first and second portions of said buckets, valve means communicating with said first and second suction ducts and one end of said main suction line, said valve means including an arcuate member having a pair of spaced apertures therein defining first and second ports communicating with the respective said first and second suction ducts and means for mounting said one end of said main suction line for selective movement along said arcuate member and into communication with one or other of said ports and thereby with said first or second said suction ducts.

10. An excavator assembly according to claim 9 and including sensing means for sensing the operative side of said bucket wheel and for causing said one end of said main suction line to be moved into communication with the said suction duct on the operative side of said bucket wheel.

11. An excavator assembly according to claim 10 wherein said one end of said main suction line is mounted on pivotal bracket means and there being provided actuator means for pivotally moving said bracket means in opposite directions and said end of said main suction line into communication with the respective said ports.

12. An excavator assembly according to claim 9 wherein said suction means includes a pump communicating with the other end of said main suction line and further duct means through which said displaced material may be pumped to a remote location.

13. An excavator assembly according to claim 9 wherein said bucket wheel is supported rotatably on one end of a support means, said support means being supported on said carriage for rotatable movement about a normally vertical axis.

* * * * *